US008769783B2

(12) United States Patent
Kawaguchi

(10) Patent No.: US 8,769,783 B2
(45) Date of Patent: Jul. 8, 2014

(54) BUCKLE

(75) Inventor: Gaku Kawaguchi, Yokohama (JP)

(73) Assignee: Nifco Inc., Yokohama-shi (JP)

( * ) Notice: Subject to any disclaimer, the term of this patent is extended or adjusted under 35 U.S.C. 154(b) by 0 days.

(21) Appl. No.: 13/702,366

(22) PCT Filed: Jun. 6, 2011

(86) PCT No.: PCT/JP2011/062953
§ 371 (c)(1),
(2), (4) Date: Dec. 20, 2012

(87) PCT Pub. No.: WO2011/155454
PCT Pub. Date: Dec. 15, 2011

(65) Prior Publication Data

US 2013/0160251 A1 Jun. 27, 2013

(30) Foreign Application Priority Data

Jun. 7, 2010 (JP) ..... 2010-130559

(51) Int. Cl.
*A44B 11/24* (2006.01)

(52) U.S. Cl.
USPC ..... 24/625; 24/614; 24/615

(58) Field of Classification Search
USPC ..... 24/614, 615, 625, 630
See application file for complete search history.

(56) References Cited

U.S. PATENT DOCUMENTS 7,096,545 B2 * 8/2006 Uehara et al. ..... 24/614
7,346,965 B2 * 3/2008 Hsiao ..... 24/625
7,979,966 B2 * 7/2011 Yoshie ..... 24/615
8,112,850 B2 * 2/2012 Uehara ..... 24/615
2005/0091808 A1 5/2005 Uehara et al.
2007/0186394 A1 * 8/2007 Hsiao ..... 24/614
2009/0007391 A1 1/2009 Uehara
2009/0056089 A1 * 3/2009 Yoshie ..... 24/616
2010/0306976 A1 12/2010 Kaneko et al.

FOREIGN PATENT DOCUMENTS

JP 2004-313268 11/2004
JP 2009-011492 1/2009
WO WO 2009/093313 A1 7/2009

OTHER PUBLICATIONS

PCT, "International Search Report for PCT/JP2011/062953", Aug. 9, 2011.

* cited by examiner

*Primary Examiner* — Robert J Sandy
*Assistant Examiner* — Abigail Morrell
(74) *Attorney, Agent, or Firm* — Manabu Kanesaka

(57) ABSTRACT

A buckle includes a male member having a pair of flexible arms mutually facing each other and disposed extending from a base part, and a female member to connect to the male member by coupling with the pair of arms. The male member has a flexible bridge connecting the pair of arms. The bridge is connected to an opposing face of each of the pair of arms facing the other arm. At the connecting portion where each of the pair of arms and the bridge are connected, the bridge is placed projecting toward the other arm from the opposing face on the arm following a tangential direction to a circle being centered on the base end of the arm and having a distance from the base end to the connecting portion as a radius.

6 Claims, 5 Drawing Sheets

BUCKLE

TECHNOLOGICAL FIELD

The present invention relates to a buckle in which a male member is connected removably to a female member.

BACKGROUND TECHNOLOGY

Conventionally, buckles comprising male members and female members, for example as described in Patent Documents 1 and 2, have been known.

On the male members configuring the buckles described in Patent Documents 1 and 2, a pair of arms mutually facing each other is provided so as to extend from a base part. On a face facing the other arm on each of the pair of arms, a U-shaped bridge connecting the pair of arms to each other is formed so that the arms do not move too far from each other.

PRIOR ART DOCUMENTS

Patent Documents

Patent Document 1: Japanese Unexamined Patent Publication No. 2009-11492

Patent Document 2: Japanese Unexamined Patent Publication No. 2004-313268

SUMMARY OF THE INVENTION

Problems to Be Solved by the Invention

Incidentally, in the abovementioned buckles described in Patent Documents 1 and 2, as described above, the sturdiness of the arms against an external force by which the pair of arms moves away from each other is assured by only the part where the pair of arms is connected to each other by the U-shaped bridge. Meanwhile, in the place where the U-shaped bridge and the arm are connected, the bridge and the arm are connected so that an angle formed by the connecting portion on the bridge near the arm and the side face of the arm becomes an acute angle. Therefore, when an external force such that the pair of arms moves away from each other is applied, a shear force arises in the place where the bridge and the arm are connected. As a result, when an external force such as described above is applied excessively, the connection between the arm and bridge is difficult to maintain, and consequently the sturdiness of the arm also is difficult to assure. Therefore, the buckles described above still leave room for improvement for increasing the sturdiness of the arm.

The present invention has been created in consideration of such circumstances, and an object thereof is to provide a buckle in which the sturdiness of the male member can be increased.

Means for Solving the Problems

In order to achieve the abovementioned object, a buckle of the present invention comprises a male member including a pair of flexible arms mutually facing each other and disposed to extend from a base part, and a female member to be engaged with said male member by connecting with said pair of arms. Said male member has a flexible bridge connecting said pair of arms. Said bridge is connected to an opposing face in which each of said pair of arms faces the other arm. Within at least a portion of a range of movability of the arm, the connecting portion connecting each of said pair of arms and said bridge is formed to project said bridge toward said other arm from said opposing face of the arm along a tangential direction of a circle being centered on the base end of the arm and having a distance from a base end to said connecting portion as a radius.

When a force such that the pair of arms moves away from each other is applied, each place on each of the pair of arms moves in a circle centered on the base end of the arm. The connecting portion where the bridge and the arm are connected also moves in such circle. According to the present invention according to first aspect, because the bridge projects along the direction of movement in at least a portion of the range that such connecting portion moves, the shear force on the connecting portion can be suppressed, and consequently the sturdiness of the buckle can be increased.

In the present invention, a main point is preferably that said radius of each of said pair of arms is equal to that of the other.

According to this preferred aspect, the tensile force on one connecting portion acts also on the other connecting portion by way of the bridge. Also, in a configuration in which the abovementioned radius of each of the pair of arms is different from the other, the abovementioned tangential direction of each of the pair of arms differs greatly, and therefore the shear force becomes greater based on interaction between the above-described connecting portions. Therefore, according to the buckle in this preferred aspect, because the abovementioned radius on each of the pair of arms is equal to the other, the shear force originating from the tensile force on one connecting portion acting on the other connecting portion can be suppressed, compared with a configuration in which the abovementioned radii are different from each other.

In the present invention, a main point is preferably that near a leading end, said pair of arms has a latched part to latch to said female member; and said connecting portion is on a side toward said base part relative to said latched part.

According to this preferred aspect, the latching force acting on the latched parts acts near the leading ends on the pair of arms, but the tensile force acting on the connecting portions acts on places different from the places of action of the abovementioned latching force. Therefore, the sturdiness of the buckle can be further increased because the latching and tensile forces no longer act on the same places.

In the present invention, a main point is preferably that said bridge has an Omega form being curved convexly toward said base part in plan view facing a plane containing said pair of arms.

According to this preferred aspect, an elastic force can be applied to the bridge. Therefore, the sturdiness of the bridge itself can be increased.

In the present invention, a main point is preferably that said bridge has a curved portion to be deformed in accordance with movement in which the leading end parts of said arms move toward and away from each other; and a restricting part for restricting an amount of deformation of said bridge by contacting with the curved portion of said bridge is placed projecting on said opposing face of each of said pair of arms on a side toward said base part relative to said bridge.

According to this preferred aspect, by the fact that the restricting part is connected with the bridge, the arms do not move too close to or far from each other, and therefore the ranges of compression force and tensile force applied to the connecting portion can be restricted.

EMBODIMENTS OF THE INVENTION

Figure 1:
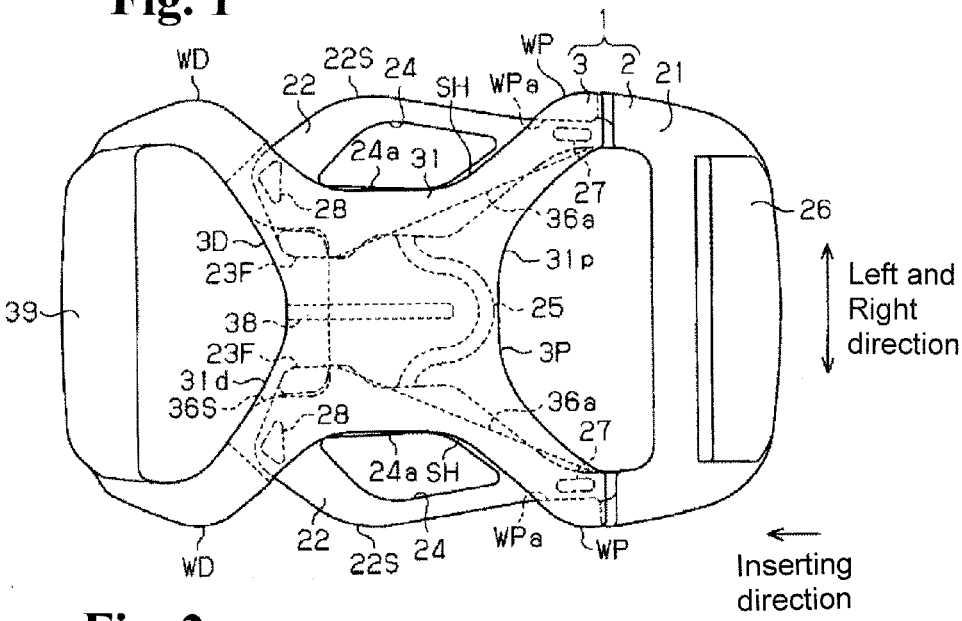
FIG. 1 is a plan view illustrating the planar structure viewed from the front side in one embodiment of the buckle according to the present invention.

One embodiment of the buckle according to the present invention is described below while referring to the drawings. The overall configuration of the buckle 1 is first described while referring to FIGS. 1 and 2. The base part 21 on the male member 2 of the buckle 1 is formed such that the pair of flexible arms 22 extends from the base part 21. Also, the female member 3 of the buckle 1 is formed in a flat tubular form, and has a front wall 31 and a rear wall 32 extending in the flatness direction (the direction parallel to the page in FIGS. 1 and 2) and facing each other. An insertion hole 3P in which the pair of arms 22 is inserted is formed on one tube end (the tube end on the right side in FIGS. 1 and 2) of the female member 3, and an open hole 3D facing the insertion hole 3P is formed on the other tube end. Below, the direction from the insertion hole 3P toward the open hole 3D is referred to as the direction of insertion (see the horizontal arrow in the drawing), and the direction in which the pair of arms is arranged is referred to as the left-to-right direction (see the vertical arrow in the drawing). Also, the side of the front wall 31 of the buckle 1 is referred to as the front side, and the side of the rear wall 32 of the buckle 1 is referred to as the rear side.

Figure 3:
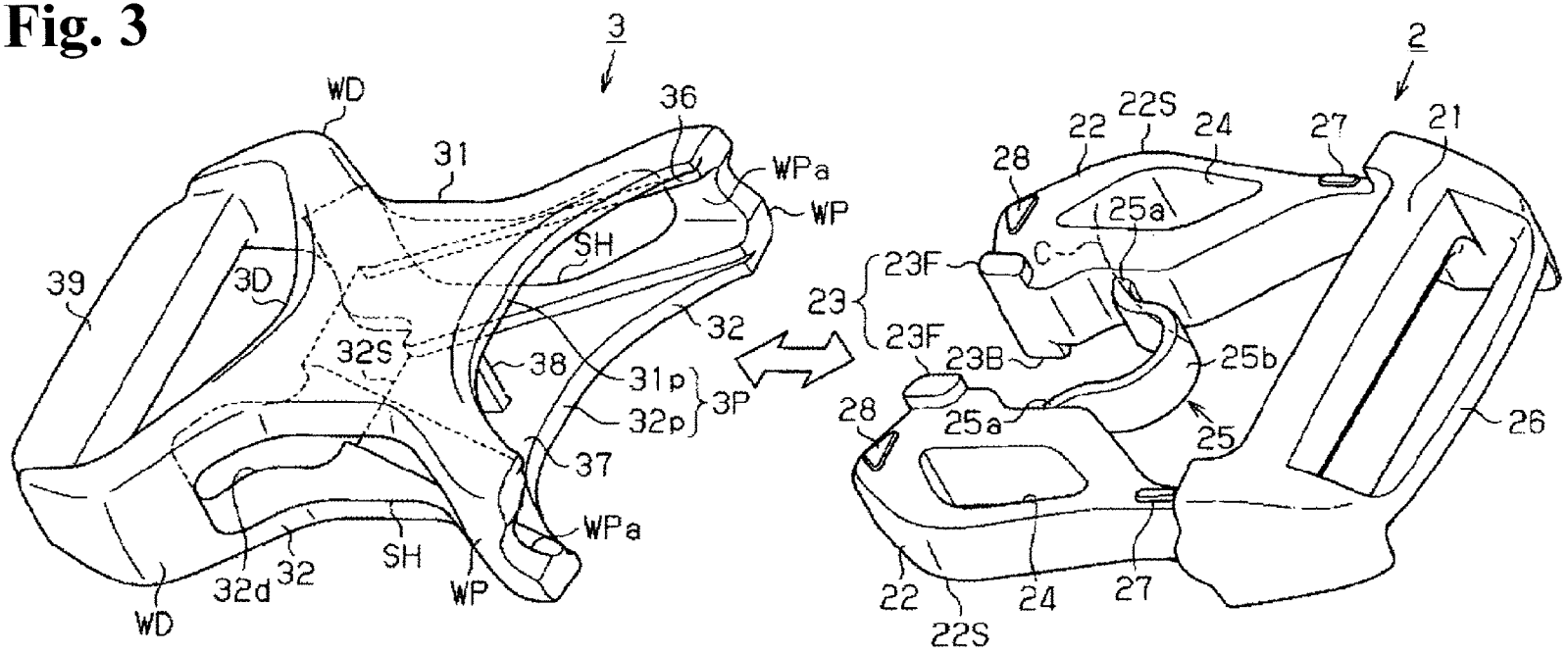
FIG. 3 is an exploded perspective view illustrating the perspective structure viewed from the front side of the buckle according to the same embodiment, the buckle having been disassembled to the male member and female member.
Figure 4:
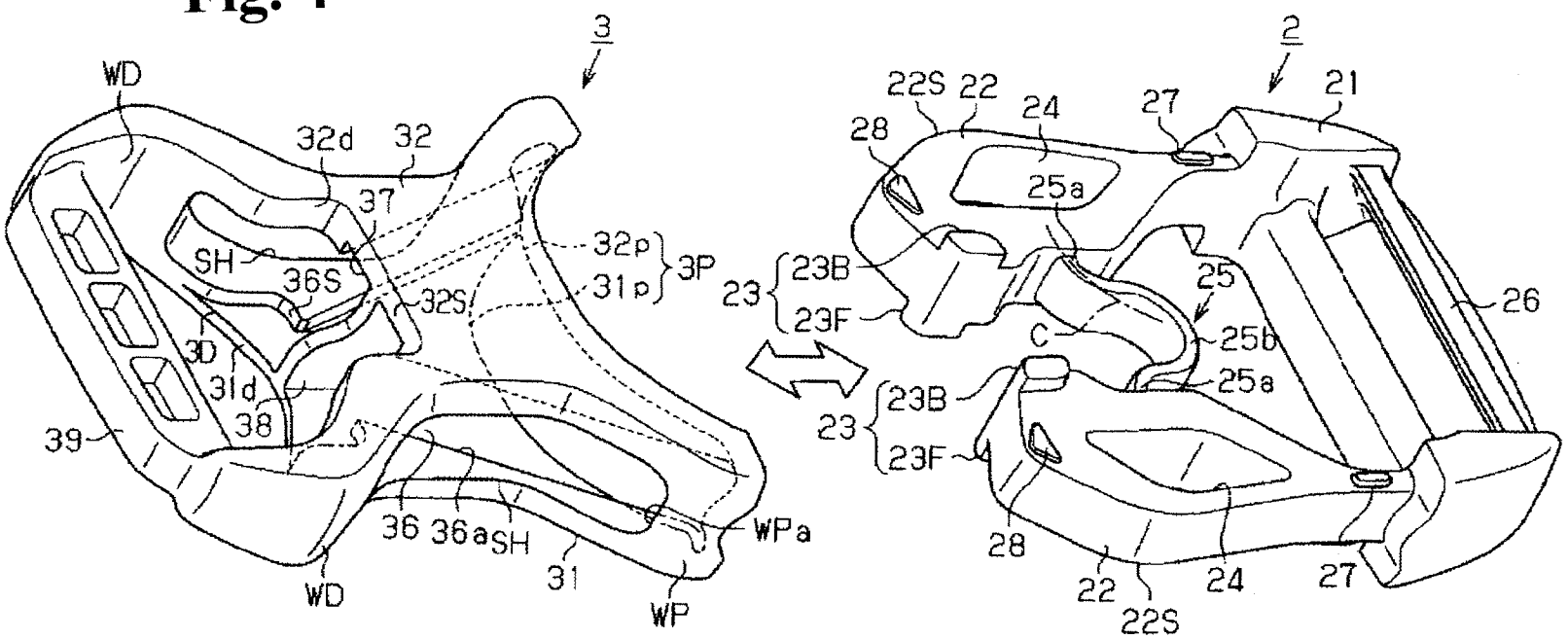
FIG. 4 is an exploded perspective view illustrating the perspective structure viewed from the rear side of the buckle according to the same embodiment, the buckle having been disassembled to the male member and female member.

As illustrated on the right side of the page in FIGS. 3 and 4, each of the pair of arms 22 on the left and right of the male member 2 is formed enlarged near the leading end in planar view facing the plane containing the pair of arms 22. Also, a right outside face on the right arm 22 and a left outside face on the left arm 22 likewise are formed in shapes curving such that arm-latching parts 22S in middle portions in the direction of insertion extend outward in the left-to-right direction in planar view facing the plane containing the pair of arms 22.

Latched parts 23 are formed respectively near the leading ends of the pair of arms 22 having the above-described external shape. The latched parts 23 are configured with a pair of front-side raised parts 23F being placed projecting on the front faces of the arms 22 and rear-side raised parts 23B being placed projecting on the rear faces of the arms 22. Also, arm holes 24 having diamond shapes in section and extending in the direction of extension of the pair of arms 22 (the above-mentioned direction of insertion) are formed running through the arms 22 from front to rear near the leading ends of the arms 22. Also, the male member 2 is formed to be plane-symmetric relative to the plane containing the pair of arms 22, that is, such that the structure of the pair of arms 22 viewed from the front side and the structure of the pair of arms 22 viewed from the rear side are identical. Because the arm holes 24 as described above are provided on each of the pair of arms 22, the strength of the arms 22 can be secured while, for example, the occurrence of sink marks can be avoided when the male member 2 is formed by resin molding.

Incidentally, base-end-positioning ribs 27 are placed respectively on the front and rear faces near the base end of the arms 22, and leading-end-positioning ribs 28 are placed respectively on the front and rear faces near the leading ends of the arms 22. In the configuration in which such positioning ribs are formed, the distance between the outer surface of the pair of arms 22 and the inner surface of the female member 3 becomes particularly short at the places where the base-end-positioning ribs 27 and leading-end-positioning ribs 28 are formed, that is, at the base ends and leading ends of the pair of arms 22, when the male member 2 is connected to the female member 3. Therefore, in the state in which the male member 2 is connected to the female member 3, shifting in position (rattling) of the male member 2 against the female member 3 can be suppressed in the thickness direction of the buckle 1.

A flexible, band-form bridge 25 connecting the pair of arms 22 to each other is formed near the leading end of the arms 22 and further toward the base end than the latch part 23 on the inner faces of the pair of arms 22 mutually facing each other. Each of two connecting portions 25*a* on the bridge 25 is formed so as to extend from one arm 22 toward the other arm 22. Also, a belt-holding part 26, by which a belt being fastened by the buckle 1 is held such that the length can be made variable, is placed across the side opposite the arms 22 relative to the base part 21.

As illustrated on the left side of the page in FIGS. 3 and 4, the front wall 31 of the female member 3 forms an X form viewed from the front side and is surrounded by four inwardly curved edges. Also, the rear wall 32 of the female member 3 forms an X form viewed from the rear side and is surrounded by four inwardly curved edges. The four corners of the front wall 31 and the four corners of the rear wall 32 configuring the female member 3 are connected by a pair of insertion-side connection walls WP near the insertion hole 3P and a pair of open-side connection walls WD near the open hole. Furthermore, guide faces WPa for aligning with the outside faces on the base end of the pair of arms 22 in the state in which the male member 2 is connected to the female member 3 are formed on the inner surfaces of the pair of insertion-side connection walls WP. Also, the insertion hole 3P being rectangular when viewed from a direction parallel to the direction of insertion is formed in a form being bordered on four sides by the abovementioned front wall 31, rear wall 32, and insertion-side connection wall WP on one tube end in the direction of insertion of the female member 3. Also, the open hole 3D being rectangular when viewed from a direction parallel to the direction of insertion is formed in a form being bordered on four sides by the abovementioned front wall 31, rear wall 32, and open-side connection wall WD on the other tube end in the direction of insertion of the female member 3.

A front-side insertion edge 31*p*, being an edge near the insertion hole 3P on the front wall 31, and a rear-side insertion edge 32*p*, being an edge near the insertion hole 3P on the rear wall, are included on the opening edge of the insertion hole 3P of the female member 3.

The front-side insertion edge 31*p* and rear-side insertion edge 32*p* each have a shape curving so as to extend toward the open hole 3D, and are formed so as to overlap each other in planar view facing the outer surface of the front wall 31 and the outer surface of the rear wall 32. Also, the external shape of the front wall 31 and the rear wall 32 is formed such that the front-side insertion edge 31*p* and a front-side opening edge 31*d* follow the external shape of the pair of arms 22 in planar view facing the outer surface of the front wall 31 and the outer surface of the rear wall 32. Also, the insertion hole 3P is formed so as to be plane-symmetric relative to the plane containing the abovementioned pair of arms 22 in the state in which the male member 2 is connected to the female member 3. Also, the front wall 31 and the rear wall 32 are formed such the abovementioned pair of arms 22 is not exposed from the insertion hole 3P in planar view facing the outer surface of the front wall 31 in the state in which the male member 2 is connected to the female member 3 (see FIGS. 1 and 2). According to such configuration, the aesthetics based on a functional sense of unity between the male member 2 and the female member 3 are increased in the state in which the male member 2 is connected to the female member 3. Also, according to the insertion hole 3P having such configuration, because the insertion hole 3P of the female member 3 and the leading end part of the pair of arms 22 are plane-symmetric with each other, the pair of arms 22 are easy to insert into the insertion hole 3P when the male member 2 is connected to the female member 3.

Meanwhile, a front-side opening edge 31*d*, being an edge near the open hole 3D on the front wall 31, and a rear-side opening edge 32*d*, being an edge near the open hole 3D on the rear wall 32, are included on the opening edge of the open hole 3D of the female member 3. Also, the open hole 3D is formed so as to become asymmetric relative to the plane containing the above pair of arms 22 in the state in which the male member 2 is connected to the female member 3.

Described in detail, the abovementioned the front-side opening edge 31*d* has a shape curving so as to extend toward the insertion hole 3P. Also, the external shape of the front wall 31 is formed such that the front-side insertion edge 31*p* and the front-side opening edge 31*d* follow the external shape of the pair of arms 22 in planar view facing the outer surface of the front wall. Also, the front wall 31 is formed such that the abovementioned pair of arms 22 is not exposed from the open hole 3D in planar view facing the outer surface of the front wall 31 in the state in which the male member 2 is connected to the female member 3 (see FIGS. 1 and 2). According to such configuration, the aesthetics based on a functional sense of unity between the male member 2 and the female member 3 are increased in the state in which the male member 2 is connected to the female member 3, just as with the abovementioned insertion hole 3P.

Also, the rear-side opening edge 32*d* also has a shape being curved so as to extend toward the insertion hole 3P just as with the abovementioned front-side opening edge 31*d*. Moreover, the rear-side opening edge 32*d* has a latching edge 32S being recessed further toward the insertion hole 3P than the abovementioned front-side opening edge 31*d* in planar view facing the outer surface of the rear wall 32. The latching edge 32S is configured with a bottom edge extending in the left-to-right direction, being the edge nearest to the insertion hole 3P, and a pair of side edges extending in the direction of insertion from both ends in the left-to-right direction on the bottom edge, in planar view facing the outer surface of the rear wall 32. Also, the abovementioned pair of arms 22 is exposed from the open hole 3D by the amount formed by the abovementioned latching edge 32S in planar view facing the outer surface of the rear wall 32 in the state in which the male member 2 is connected to the female member 3.

Figure 2:
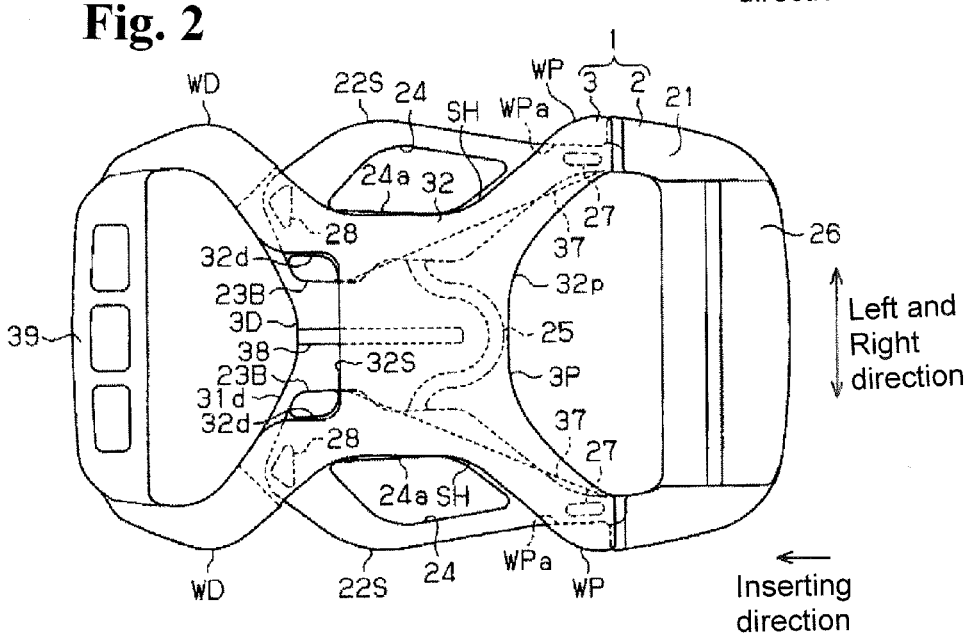
FIG. 2 is a plan view illustrating the planar structure viewed from the rear side of the buckle according to the same embodiment.

The rear wall 32 is formed such that the bottom edge configuring the abovementioned latching edge 32S and the abovementioned pair of rear-side raised parts 23B contacts, and only the abovementioned pair of rear-side raised parts 23B is exposed from the latching edge 32S, in the state in which the male member 2 is connected to the female member 3 (see FIGS. 1 and 2). Also, in the state in which the male member 2 is connected to the female member 3, the rear-side raised parts 23B of the abovementioned pair of arms 22 contact with the bottom edge of the latching edge 32S, and the rear-side raised parts 23B become difficult to move toward the side of the insertion hole 3P. According to such configuration, because a portion of the open hole 3D functions as a part for latching on the rear-side raised part 23B, the configuration of the female member 3 can be made simpler compared with a configuration in which such latching part is formed separately.

Also, the thickness of the rear wall 32 on the latching edge 32S is formed to be larger than the thickness of the rear-side raised parts 23B. According to such configuration, the rear-side raised parts 23B do not project from the outer surface of the rear wall 32 in the state in which the rear-side raised part 23B and the latching edge 32S are coupled. Therefore, the coupling between the rear-side raised parts 23B formed on the pair of arms 22 and the latching edge 32S formed on the rear wall 32 is not subject to interference from the outside. As a result, a situation in which the connection between the male member 2 and the female member 3 is released by an unanticipated cause can be suppressed.

A front-side guide groove 36 extending in the direction of insertion is formed on the inner surface of the front wall 31 as illustrated on the left side of the page in FIG. 4. The front-side guide groove 36 has a front-side insertion groove 36*a* being formed such that the groove width becomes narrower by a constant ratio going from the front-side insertion edge 31*p* toward the open hole 3D, and a latching groove 36S being spread open on the side of the abovementioned front-side insertion groove 36*a* toward the open hole 3D. The groove side wall configuring the latching groove 36S is formed so as to overlap with the above-described latching edge 32S in planar view facing the outer surface of the rear wall 32. Also, the front-side raised parts 23F of the abovementioned pair of arms 22 slide contact with the groove side wall of the front-side insertion groove 36*a* and are guided to the latching groove 36S when the male member 2 is inserted into the female member 3. Also, in the state in which the male member 2 is connected to the female member 3, the front-side raised parts 23F of the abovementioned pair of arms 22 contact with the groove side wall of the latching groove 36S, and the front-side raised parts 23F become difficult to move toward the side of the insertion hole 3P.

Also, a rear-side guide groove 37 extending in the direction of insertion is formed on the inner surface of the rear wall 32 as illustrated on the left side of the page in FIG. 3. The rear-side guide groove 37 is formed such that the groove width becomes narrower going from the rear-side insertion edge 32*p* to the latching edge 32S. The groove side wall configuring the rear-side guide groove 37 is formed so as to overlap with the above-described front-side insertion groove 36*a* in planar view facing the outer surface of the rear wall 32. Also, the rear-side raised parts 23B of the abovementioned pair of arms 22 slide contact with the groove side wall of the rear-side guide groove 37 and are guided to the latching edge 32S when the male member 2 is inserted into the female member 3.

Furthermore, a pair of arm insertion holes SH mutually facing each other is formed in a direction orthogonal to the abovementioned direction of insertion, in addition to the above-described insertion hole 3P and open hole 3D, on the female member 3. The pair of arm insertion holes SH is formed in a rectangular form being bordered on four sides by the front wall 31, rear wall 32, insertion-side connection wall WP, and open-side connection wall WD when viewed from a direction parallel to the left-to-right direction. Also, the opening edge of the pair of arm insertion holes SH is formed in a form following the inner perimeter surface 24*a* of the arm holes 24 of the above-described pair of arms 22. The pair of arm insertion holes SH is formed in a form in which the arm holes 24 of the pair of arms 22 are exposed to the outside of the female member 3 and each of the pair of arm insertion holes SH is covered by the respective arm 22 in the state in which the male member 2 is connected to the female member 3. According to such configuration, the shape of the inner perimeter surface 24*a* of the arm hole 24 follows the shape of the opening of the arm insertion hole SH (see FIGS. 1 and 2). Therefore, the aesthetics based on a functional sense of unity between the male member 2 and the female member 3 of the buckle 1 are brought about, while the invasion of foreign matter into the inside of the female member 3 from the pair of arm insertion holes SH can be suppressed.

Also, a partition plate 38 connecting the center in the left-to-right direction of the abovementioned front-side guide groove 36 and the center in the left-to-right direction of the abovementioned rear-side guide groove 37 is formed so as to extend in the direction of insertion inside the female member 3. By forming the partition plate 38 having such configuration, the front wall 31 and the rear wall 32 of the female member 3 can be prevented from bending. Also, a belt attachment part 39, by which a belt being fastened by the buckle 1 is attached such that the length is unchangeable, is provided on the end part in the direction of insertion of the female member 3. Three bottomed holes are provided on the belt attachment part 39 in order to make the buckle 1 lightweight.

Also, as illustrated in FIGS. 1 and 2, when the pair of arms 22 is inserted in the direction of insertion from the insertion hole 3P, first, the leading end of the pair of arms 22 advances into the inside of the female member 3 while the outer faces of the arms 22 slide contact with the guide faces WPa. Next, the pair of front-side raised parts 23F being placed projecting on the front faces of the arms 22 are guided following the front-side insertion groove 36*a* to the latching groove 36S. Also, the pair of rear-side raised parts 23B being placed projecting on the rear faces of the arms 22 are guided following the rear-side guide groove 37 to the open hole 3D.

At this time, the outer face on each of the pair of arms 22 has a shape so as to extend to the outside in the left-to-right direction at the arm-latching part 22S. Also, the guide faces WPa on the pair of insertion-side connection walls WP have a shape aligning with the outer faces on the base ends of the pair of arms 22. Therefore, when the pair of arms 22 is inserted into the female member 3, the outer faces of the arms 22 are pressed toward the center in the left-to-right direction by the guide faces WPa to the extent that the outer faces on the pair of arms 22 extend further outside from the guide faces WPa. As a result, the pair of arms 22 is bent most greatly toward the center in the left-to-right direction when the arm-latching parts 22S are positioned on the guide faces WPa. Also, when the arm-latching parts 22S pass the guide faces WPa, the inward pushing of the guide faces WPa on the outer faces of the arms 22 is released, and the bending of the pair of arms 22 follows the guiding of the front-side insertion groove 36*a* and the rear-side guide groove 37. The groove width of the front-side insertion groove 36*a* and the rear-side guide groove 37 is formed so as to become narrower by a constant ratio going from the insertion hole 3P toward the open hole 3D. Therefore, before the pair of arms 22 is inserted following the guiding of the abovementioned front-side insertion groove 36*a* and rear-side guide groove 37, the pair of arms 22 first advances into the inside of the female member 3 while bending by a constant ratio toward the center in the left-to-right direction. According to such configuration, because the external force on the arms 22 is once increased when the arm-latching parts 22S pass the guide faces WPa, the pair of arms 22 can be provisionally fastened to the female member 3 by the coupling between the arm-latching parts 22S and the guide faces WPa.

Also, when the pair of arms 22 is inserted further into the female member 3, the front-side raised parts 23F reach the latching groove 36S, and the rear-side raised parts 23B reach the open hole 3D. Thus, because the latching groove 36S is spread open from the front-side insertion groove 36*a*, and because the latching edge 32S is spread open from the rear-side guide groove 37, the pair of arms 22 having been bent toward the center in the left-to-right direction mutually spread outward in the left-to-right direction following the shape of the latching groove 36S and the shape of the latching edge 32S. By this, the front-side raised parts 23F contact with the groove side walls of the latching groove 36S, and the front-side raised parts 23F become difficult to move to the side of the insertion hole 3P. Also, the rear-side raised parts 23B contact with the bottom edges of the latching edge 32S, and the rear-side raised parts 23B become difficult to move to the side of the insertion hole 3P. Also, the male member 2 is connected to the female member 3.

Figure 5:
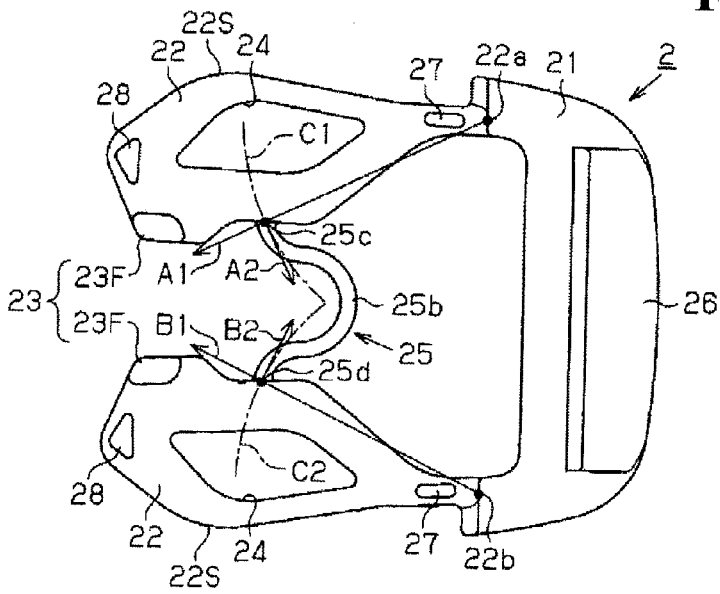
FIG. 5 is a plan view illustrating the planar structure viewed from the front side of the male member according to the same embodiment.
Figure 6:
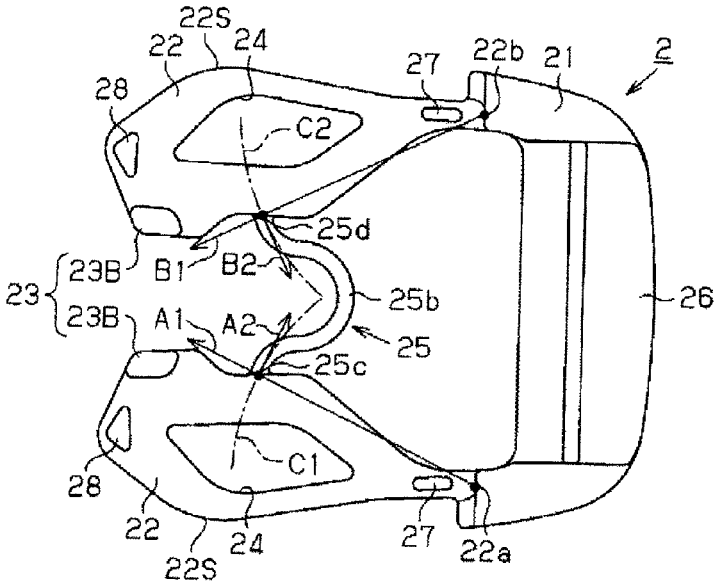
FIG. 6 is a plan view illustrating the planar structure viewed from the rear side of the male member according to the same embodiment.

The configuration of the abovementioned bridge 25 is next described in detail following FIGS. 5 and 6. As illustrated in FIGS. 5 and 6, the direction A1 is the direction from the rotational center 22*a* of the base end of the right arm 22 positioned on the page upper side in FIG. 5 and on the page lower side in FIG. 6 toward the first connecting portion 25*c* being the connecting portion where the bridge 25 is connected to the right arm 22. Also, the direction A2 is the direction in which the bridge 25 projects from the first connecting portion 25*c*, and the arc C1 is the arc being centered on the rotational center 22*a*, having the distance from the rotational center 22*a* to the first connecting portion 25*c* as the radius, and passing through the first connecting portion 25*c*. At this time, the direction A2 is prescribed as a tangential direction tangential to the arc C1 at the first connecting portion 25*c*, in other words, a direction orthogonal to the direction A1 on the plane containing the pair of arms 22.

At the same time, the direction B1 is the direction from the rotational center 22*b* of the base end of the left arm 22 positioned on the page lower side in FIG. 5 and the page upper side in FIG. 6 toward the second connecting portion 25*d* being the connecting portion of the bridge 25 to the arm 25. Also, the direction B2 is the direction in which the bridge 25 projects from the second connecting portion 25*d*, and the arc C2 is the arc being centered on the rotational center 22*b*, having the distance from the rotational center 22*b* to the second connecting portion 25*d* as the radius, and passing through the second connecting portion 25*d*. At this time, the direction B2 is prescribed as a tangential direction tangential to the arc C2 at the second connecting portion 25*d*, in other words, a direction orthogonal to the direction B1 on the plane containing the pair of arms 22.

That is, the direction in which the bridge 25 projects from the opposing face on each of the pair of arms 22 is made to coincide with a tangential direction to each arc drawn by the connecting portion on each of the pair of arms 22 centered on the base end of the arm 22. In the present embodiment, the pair of arms 22 and the bridge 25 are connected such that the radii of the arc C1 and the arc C2 become equal to each other.

Also, the middle part 25*b* on the bridge 25 is formed in a form curving convexly toward the base part 21 between one arm 22 and the other arm 22. Also, the bridge 25 is formed in an Omega form in planar view facing the plane containing the pair of arms 22.

According to the bridge 25 having such configuration, even in the case when an excessive external force is applied in a direction to widen the interval between the pair of arms 22, the external force acts in the direction of the direction A2 on the first connecting portion 25*c*, and acts in the direction of the direction B2 on the second connecting portion 25*d*. That is, because the directions A2 and B2 in which the external force acts on the first connecting portion 25*c* and the second connecting portion 25*d* coincide with the directions in which the bridge 25 is placed projecting, a shear force does not tend to occur at the first connecting portion 25*c* and the second connecting portion 25*d*. Also, an elastic force can be applied to the bridge 25 itself.

In the case in which the abovementioned radii are mutually different in the pair of arms 22, a tensile force on one connecting portion often acts on the other connecting portion by way of the bridge 25. Also, in a configuration in which the abovementioned radii in the pair of arms 22 are mutually different, the abovementioned tangential directions on the pair of arms 22 differ greatly. Therefore, in the case in which the abovementioned radii are mutually different in the pair of arms 22, the shear force on each connecting portion becomes greater based on the interaction between the above-described connecting portions. Therefore, in the pair of arms 22 in the present embodiment, the radii of the arc C1 and the arc C2 are equal to each other. Therefore, even if tensile forces on the first connecting portion 25*c* and the second connecting portion 25*d* interact on the second connecting portion 25*d* and the first connecting portion 25*c*, the tensile forces become equal to each other, therefore the forces acting on the first connecting portion 25*c* and the second connecting portion 25*d* also become equal, and the directions in which the tensile forces act become roughly opposite directions to each other. Therefore, the shear force originating from the above-described interaction can also be suppressed in the first connecting portion 25*c* and the second connecting portion 25*d*.

In addition, because the first connecting portion 25*c* and the second connecting portion 25*d* are provided in positions away from the latched parts 23, the coupling force received by the latched parts 23 do not act on the first connecting portion 25*c* and the second connecting portion 25*d*. Therefore, the strength of each connecting portion of the bridge 25 to the arm 22 can be maintained effectively, and consequently the rigidity of the male member 2 can be increased.

Also, because the first connecting portion 25*c* and the second connecting portion 25*d* are formed further toward the base end than the latched parts 23 on inside faces of the pair of arms 22 mutually facing each other, the radii of the arc C1 and the arc C2 can be made smaller compared with the case in which the connecting portions 25*c*, 25*d* are formed on the leading end portions of the arms 22. Therefore, the amount of deformation of the first connecting portion 25*c* and the second connecting portion 25*d* can be made smaller, in other words, the tensile force on the first connecting portion 25*c* and the second connecting portion 25*d* can be reduced, and therefore the rigidity of the male member 2 can be further increased.

According to the buckle according to the present embodiment as described above, effects as enumerated below can be obtained.

(1) The flexible bridge 25 connecting the pair of arms 22 is connected to the opposing face of each of the pair of arms 22 facing the other arm 22. Also, at the connecting portion 25*a* between the bridge 25 and the arm 22, the bridge 25 is placed projecting from the abovementioned opposing face on the arm 22 toward the other arm 22 following a tangential direction to an arc C being centered on the base end of the arm 22 and having the distance from the base end to the connecting portion 25*a* as the radius. In other words, the bridge 25 is placed projecting following the direction in which the first connecting portion 25*c* and the second connecting portion 25*d* connecting the bridge 25 and the arms 22 move. Therefore, the shear force on the first connecting portion 25*c* and the second connecting portion 25*d* can be suppressed, and consequently the sturdiness of the buckle 1 can be increased.

(2) The abovementioned radii of each of the pair of arms 22 are made equal to each other. Because the abovementioned radii of each of the pair of arms 22 are equal to each other, even in the case in which a tensile force on one connecting portion acts on the other connecting portion, the shear force on the first connecting portion 25*c* and the second connecting portion 25*d* can be suppressed compared with a configuration in which the abovementioned radii are different from each other.

(3) On the pair of arms 22, the latched part 23 to be latched to the female member 3 is formed near the leading end, and the connecting portion is formed on the side toward the base part 21 relative to the latched part 23. By this, the latching force acting on the latched part 23 acts near the leading end on the pair of arms 22, while the tensile force acting on each connecting portion 25*a* acts on a portion different from the latched part 23, being the portion of action of the abovementioned latching force. Therefore, because the latching force and the tensile force do not act on the same portion of the arm 22, the sturdiness of the buckle 1 can be further increased.

(4) The bridge 25 is formed in an Omega form curving toward the base part 21 in planar view facing opposite the plane containing the pair of arms 22. By this, an elastic force can be applied to the bridge 25.

The abovementioned embodiment can also be carried out with modes such as the following.

Figure 7:
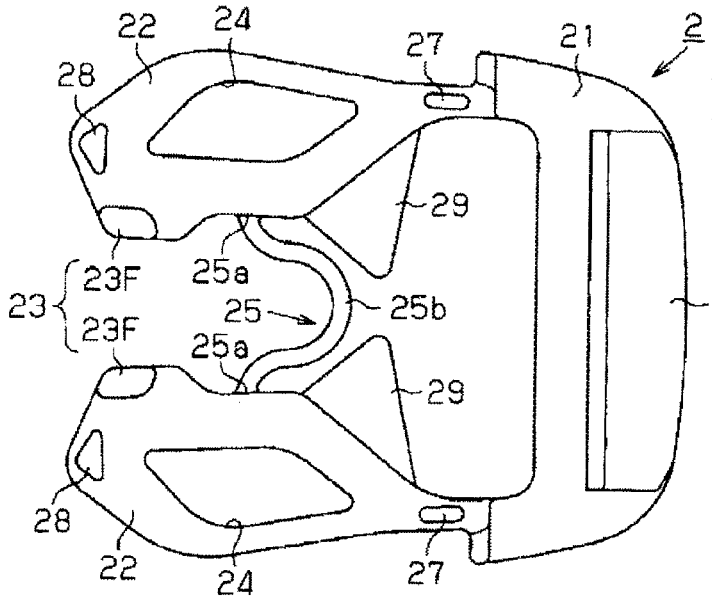
FIG. 7 is a plan view illustrating the planar structure viewed from the front side of the male member according to another embodiment.
Figure 8:
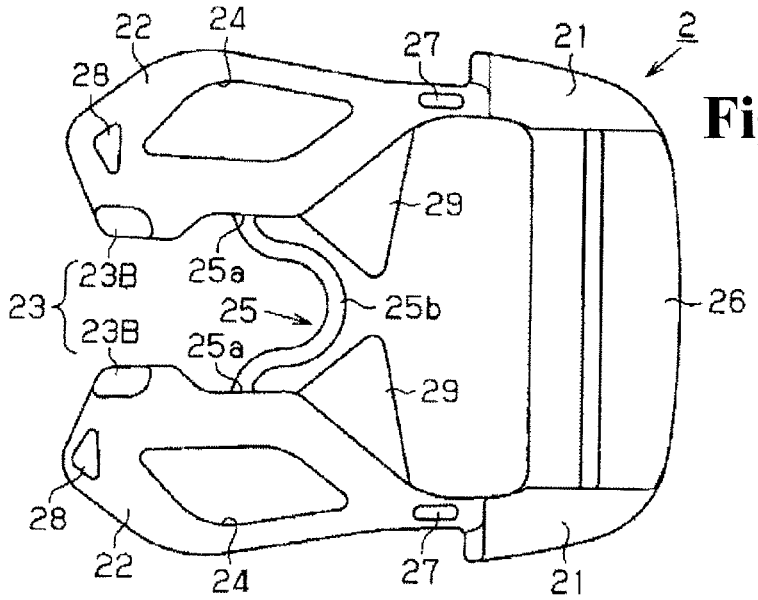
FIG. 8 is a plan view illustrating the planar structure viewed from the rear side of the male member according to another embodiment.

The bridge 25 having the above-described configuration is deformed so as to extend considerably in the direction of insertion when the leading end parts of the arms 22 move toward each other. Also, the bridge 25 is deformed such that the leading end parts of the arms 22 mutually spread considerably in the left-to-right direction. Therefore, to restrict the amount of deformation of such bridge 25, the configuration may be such that a restricting part for restricting an amount of deformation of the bridge 25 by contacting with the middle part 25*b* being the curved portion of the bridge 25 is placed projecting on the opposing face on each of said pair of arms 22 on a side toward the base part 21 relative to the bridge 25. For example, as illustrated in FIGS. 7 and 8, the configuration may be such that a pair of triangular plate-form restricting parts 29 having inclined surfaces that widen in the left-to-right direction while approaching the leading ends of the pair of arms 22 is formed on the base part 21 of the bridge 25.

According to the restricting parts 29 having such configuration, when the leading end parts of the arms 22 move toward each other and the bridge 25 is deformed so as to extend in the direction of insertion, the abovementioned inclined surfaces of the restricting parts 29 contact with the middle part 25*b* of the bridge 25. Also, the amount of deformation of the bridge 25 in the direction of insertion is restricted by the restricting parts 29, and as a result the arms 22 can be prevented from moving too close to each other. Also, when the leading end parts of the arms 22 move away from each other and the bridge 25 is deformed so as to widen in the left-to-right direction, here too the middle part 25*b* of the bridge 25 and the abovementioned inclined surfaces of the restricting parts 29 contact. Also, the amount of deformation of the bridge 25 in the left-to-right direction is restricted by the restricting parts 29, and as a result the arms 22 can be prevented from moving too far away from each other. Consequently, the arms 22 can be prevented from moving too close to each other and too far from each other. Therefore, the compression force and tensile force applied to the first connecting portion 25*c* and the second connecting portion 25*d* can be suppressed.

As illustrated in FIGS. 3 to 8, the middle part 25*b* of the bridge 25 is formed so as to curve convexly toward the base part 21 between one arm 22 and the other arm 22. This may be changed, and the bridge 25 may be formed so as to curve convexly toward the leading ends of the arms 22 between one arm 22 and the other arm 22. However, the position where the restricting parts 29 for contacting with the bridge 25 are placed also is suitably changed. That is, in the case of a shape that curves convexly toward the leading ends as described above, the restricting parts 29 are formed further toward the leading ends of the arms 22 than the first connecting portion 25*c* and the second connecting portion 25*d*. The partition plate 38 formed on the female member 3 and the bridge 25 and restricting part 29 must be made so as not to interfere with each other.

The first connecting portion 25*c* and the second connecting portion 25*d* are on the side toward the base part 21 relative to the latched parts 23. This may be changed, and the first connecting portion 25*c* and the second connecting portion 25*d* may be on the side toward the leading ends of the arms 22 relative to the latched parts 23. Even with such configuration, the effects according to the abovementioned (1) to (3) can be obtained. Or, the first connecting portion 25*c* and the second connecting portion 25*d* may be in the same position as the latched parts 23 in the direction of insertion. Even with such configuration, the effects according to the abovementioned (1) and (2) can be obtained.

The abovementioned radii of the pair of arms 22 are equal. This may be changed, and the configuration may be such that the abovementioned radii of the pair of arms 22 are different from each other. Even with such configuration, the effect according to the abovementioned (1) can be obtained.

The connecting portions 25*a* between the bridge 25 and the arms 22 are formed in a tangential direction to the arc C on the male member 2 before connection. Meanwhile, in the case in which the rigidities of the arms 22 and the bridge 25 are different from each other, the amount of deformation of the arms 22 and the amount of deformation of the bridge 25 are often different from each other in the process in which the male member 2 is inserted into the female member 3. Therefore, based on a configuration such as the abovementioned, the direction of extension of the connecting portions 25*a* may also change in the process of connection. Therefore, the present invention is not limited to the above-described configuration, and the configuration should be such that the connecting portions 25*a* are formed such that the bridge 25 projects from the opposing face toward the other arm 22 following a tangential direction to the abovementioned arc C, for example, in at least a portion of the process of connection, in other words, in at least a portion of the range of movability of the arm. For example, the configuration may be such that the connecting portions 25*a* are placed projecting in the normal direction relative to one opposing face in the state before connection. In short, the configuration should be such that the bridge 25 is formed such that the connecting portions 25*a* project following a tangential direction to the arc C in at least a portion of the process of connection. Even with such configuration, given there is a chance for the bridge 25 to project following the direction in which the connecting portions 25*a* move, the shear force on the connecting portions 25*a* can be suppressed, and consequently the sturdiness of the buckle 1 can be increased.

As illustrated on the right side of the page in FIGS. 3 and 4, the width of the bridge 25 in the thickness direction of the buckle 1 is smaller than the thickness of the arms 22 in the same thickness direction, and a step is formed on the first connecting portion 25*c* and on the second connecting portion 25*d*. This may be changed, and the configuration may be such that the width of the bridge 25 in the thickness direction of the buckle 1 is equal to the thickness of the arms 22 in the same thickness direction, and the abovementioned step is not formed on the first connecting portion 25*c* and on the second connecting portion 25*d*. Or, the width of the bridge 25 in the thickness direction of the buckle 1 may be larger than the thickness of the arms 22 in the same thickness direction. By this, because the relationship between the width of the bridge 25 in the thickness direction of the buckle 1 and the thickness of the arms 22 in the same thickness direction can be freely selected, the rigidity of the arms 22, the spring constant of the bridge 25, and the like, can be suitably set in accordance with the product specification.

The configuration may be such that the outside faces on the left and right sides of the arms 22 are latched on the outer edges of the arm insertion holes SH near the insertion hole 3P. In short, the buckle should be one in which a male member is inserted into and connected to a female member, and one in which the base end portions and leading end portions of the pair of arms provided on the male member are contained in the female member.

The configuration may be such that the arm holes 24 in the pair of arms 22 are spared. Even in such case, the intrusion of foreign matter from the tube side faces, that is, from the arm insertion holes SH, of the female member 3 being formed in a flat tube form can be prevented by the arms 22.

Although the partition plate 38 was provided, the present invention is not limited to this, and the configuration may be such that the partition plate 38 is spared.

Although three bottomed holes were provided on the belt-attachment part 39, the present invention is not limited to this, and any number of bottomed holes may be provided, or bottomed holes may not be provided.

The configuration may be such that the belt-holding part 26, by which a belt being fastened by the buckle 1 is held such that the length can be changed, is formed on the female member 3, and the belt attachment part 39, by which the belt being fastened by the buckle 1 is attached such that the length is unchangeable, is formed on the male member 2. Even in such case, the length of the belt when fastening with the buckle 1 can be changed.

The entire contents of the specification, claims, drawings, and abstract of Japanese Patent Application No. 2010-130559 filed on Jun. 7, 2010 are incorporated by reference herein as a disclosure of the specification of the present invention.

What is claimed is:

1. A buckle, comprising:

a male member including a base part, a pair of flexible arms mutually facing each other, each extending from a base end at the base part, and a flexible bridge connected to and interposed between said pair of flexible arms and having an Omega form portion curved convexly toward said base part; and a female member connected to said male member by engaging with said pair of flexible arms;

wherein said pair of flexible arms and said bridge are connected at connecting portions, and said bridge projects, at one connecting portion, inwardly from one of the pair of flexible arms along a first tangent line of a first imaginary circle centered on the base end and having a first radius from the base end to said one connecting portion to suppress a shear force on the connecting portion.

2. The buckle according to claim 1, wherein the base end includes a first base end from which the one of the pair of flexible arms is extended and the first imaginary circle is centered, and a second base end from which another one of the pair of flexible arms is extended and a second imaginary circle is centered, the second imaginary circle defining a second radius from the second base end to another connecting portion;

wherein the bridge projects at the other connecting portion inwardly from the other one of the pair of flexible arms along a second tangent line of the second imaginary circle; and wherein the first radius is equal to the second radius.

3. The buckle according to claim 1, wherein each of said pair of flexible arms has a leading end opposed to the base end and a latched part near the leading end to latch to said female member; and said connecting portion is arranged between said base part and said latched part.

4. The buckle according to claim 1, wherein each of said pair of flexible arms has a leading end part opposed to the base end, and the Omega form portion deforms corresponding to movements of the leading end parts of said pair of flexible arms moving toward and away from each other; and each of the pair of flexible arms further comprises a restricting part projecting inwardly therefrom at a position away from said base part such that the restricting part contacts the Omega form portion of the bridge to restrict an amount of deformation of said bridge when the leading end parts move toward each other and the bridge is deformed.

5. The buckle according to claim 1, wherein the bridge has a width defined by a first side surface and a second side surface, and the bridge projects along the tangent line of the circle in the width of the bridge.

6. The buckle according to claim 1, wherein the female member comprises a front wall, a rear wall facing the front wall, and a partition plate formed between the front wall and the rear wall and extending in an insertion direction; and the partition plate is positioned in a space between the pair of flexible arms when the male member is connected to the female member.

* * * * *